United States Patent [19]

Bernas

[11] Patent Number: 4,913,033

[45] Date of Patent: Apr. 3, 1990

[54] STEAM ENGINE

[76] Inventor: Martin Bernas, Vattenverksgatan 2D, S-57100 Nässjö , Sweden

[21] Appl. No.: 296,347

[22] Filed: Jan. 9, 1989

Related U.S. Application Data.

[63] Continuation of Ser. No. 103,592, Oct. 1, 1987, abandoned.

[51] Int. Cl.[4] ..... F01B 1/02

[52] U.S. Cl. ..... 92/73; 92/147; 92/146; 92/165 R; 92/139; 74/597

[58] Field of Search ..... 92/73, 146, 147, 161, 92/148, 149; 248/678, 679, 676; 74/597, 598; 123/71 R, 195 A

[56] References Cited

U.S. PATENT DOCUMENTS

| | | | |
|---|---|---|---|
| 514,747 | 2/1894 | Brown | 92/73 |
| 1,536,401 | 5/1925 | L'Orange | 123/195 A |
| 1,613,256 | 1/1927 | Wachs | 92/147 |
| 1,694,535 | 12/1928 | Fejes | 92/147 |
| 1,753,925 | 4/1930 | Gorr | 92/147 |
| 1,864,004 | 6/1932 | Stevens | 92/147 |
| 2,012,778 | 8/1935 | Shimer | 92/147 |
| 2,056,622 | 10/1936 | Schaer | 92/147 |
| 2,443,692 | 6/1948 | Mueller | 92/147 |
| 2,471,982 | 5/1949 | Shulda | 74/597 |
| 2,578,079 | 12/1951 | Meinertz | 92/147 |
| 3,340,747 | 9/1967 | Waker et al. | 74/598 |
| 3;349,761 | 10/1967 | Hellstrom | 92/147 |
| 4,477,237 | 10/1984 | Grable | 92/73 |

FOREIGN PATENT DOCUMENTS

| | | | |
|---|---|---|---|
| 47393 | 5/1933 | Denmark | 92/147 |
| 0351218 | 4/1922 | Fed. Rep. of Germany . | |
| 0475363 | 5/1915 | France | 74/598 |
| 0690609 | 5/1929 | France | 74/598 |
| 0266845 | 8/1929 | Italy | 92/147 |
| 296140 | 5/1932 | Italy | 92/147 |
| 61766 | 12/1939 | Norway | 92/147 |
| 0164284 | 12/1933 | Switzerland | 92/161 |
| 9910 | 7/1916 | United Kingdom | 123/71 R |
| 0336929 | 10/1930 | United Kingdom | 92/147 |
| 0342610 | 2/1931 | United Kingdom | 92/147 |

*Primary Examiner*—Randall L. Green
*Assistant Examiner*—Thomas Denion
*Attorney, Agent, or Firm*—Michael, Best & Friedrich

[57] ABSTRACT

A steam engine, which comprises a crankcase frame (1) arranged so as to rest on a foundation, a steam cylinder (25) supported by the crankcase frame, a cylinder bore (28) in the steam cylinder, a reciprocating piston (45) in the cylinder bore (1), a connecting rod (50), connected at one end with the piston by means of a piston rod (46), steam valves on the cylinder, a crankshaft (56) with crank webs (57, 65) supporting a crank pin (63), for the other end of the connecting rod a crank pin (63), and in the crankcase a plurality of crankshaft bearings (8) allowing rotation of the crankshaft. The crankcase frame's (1) principal supporting members consist of two horizontally lying beams (2), arranged so as to support between themselves the crank bearings (8) for the crankshaft (56), from each of the lying beams vertically standing beams (12) forming columns for supporting a plate with a hole (14) for the cylinder (25) as well as beams (15) extending between the vertically standing beams for bracing the standing beams. The plate is arranged so as to support in its hole (14) the cylinder (25), formed as a unit, which by means of a guide extends down into the hole (14).

19 Claims, 3 Drawing Sheets

STEAM ENGINE

CROSS REFERENCE TO RELATED APPLICATION

This application is a continuation of U.S. patent application Ser. No. 07/103,592, filed 10-1-87, now abandoned.

GENERAL DESCRIPTION

1. Field of the Invention

The present invention relates to a steam engine which comprises a crankcase frame arranged so as to rest on a foundation, at least one steam cylinder supported by the crankcase frame, a cylinder bore in the steam cylinder or in each of the steam cylinders, a reciprocating piston in the cylinder bore, a connecting rod, connected at one end with the piston by means of a piston rod, preferrably guided by a cross-head guide a plurality of valve devices on the cylinder to supply pressurized steam to the cylinder against the piston in order to produce its motion as well as for removing the expanded steam, a crankshaft with crank webs supporting a crank pin, for the other end of the connecting rod for several cylinders a corresponding number of crank pins, and in the crankcase a plurality of crankshaft bearings allowing rotation of the crankshaft.

2. Background Prior Art

Steam engines have been built for a long time. In connection with renewed interest, solutions have been sought which are more efficient than those found in older constructions. The present invention relates to a steam engine for which efficient solutions for producing the engine frame and the crankshaft have been realized. The purpose has been to achieve efficient production using modern machinery and methods to obtain low weight and to obtain bearings for the crank mechanism having low energy consumption and low maintenance requirements for, for example, lubrication.

SUMMARY OF THE INVENTION

By means of the invention a simple and inexpensive steam engine is realized having simplified maintenance. It is consequently more practicable even in nonindustialized areas.

The purpose of the invention is achieved by arranging the steam engine so that the crankcase frame's principal supporting members consist of a plurality of profile beams, which are preferrably of a standard type such as I-beams, of which two are horizontally lying beams, arranged so as to support between themselves the crank bearings for the crankshaft from each of the lying beams vertically standing beams forming columns for supporting a plate with a hole for the cylinder or for each cylinder a hole, as well as members extending between the vertically standing beams, preferrably beams for bracing the standing beams, whereby the plate is arranged so as to support in its hole the cylinder, formed as a unit, which is guided down into the hole and, with a flange surface, rests against the outer side of the plate.

DESCRIPTION OF A PREFERRED EMBODIMENT

Figure 1:
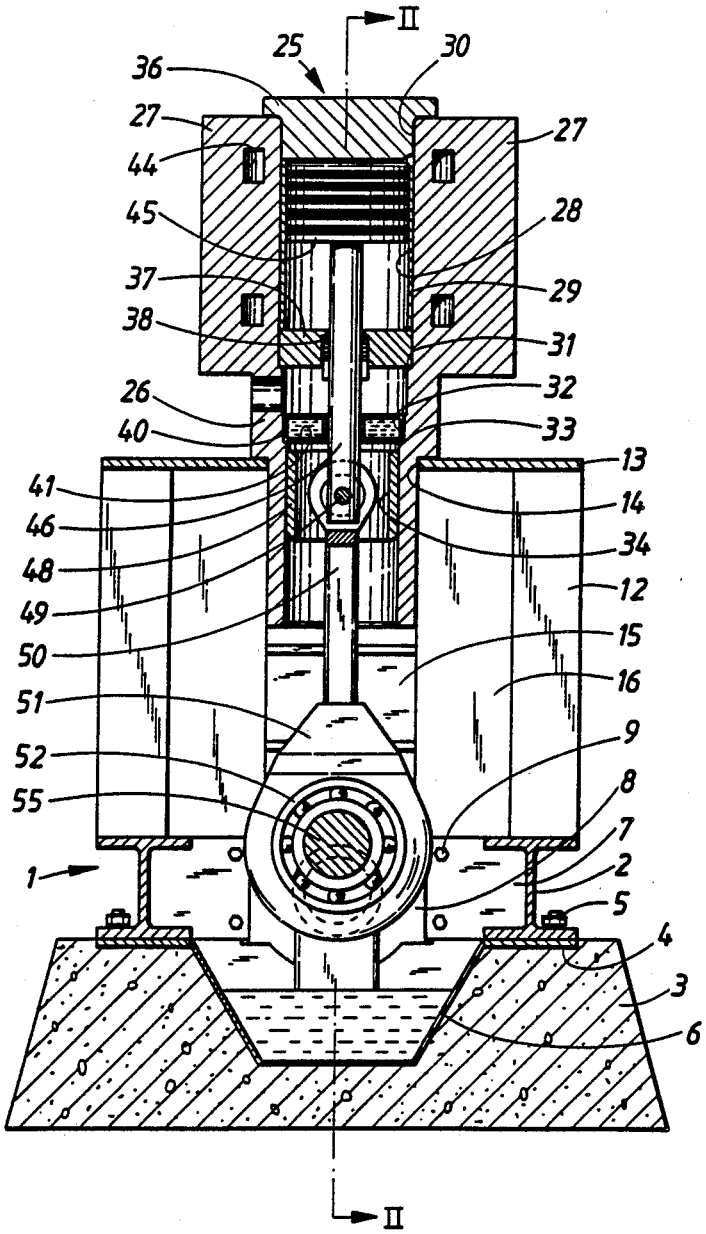
FIG. 1 shows a cross section of a single-cylinder steam engine embodying the invention.

As is shown in FIG. 1, a crankcase frame 1 for the engine is formed from two lower I-beams 2. Each of these rests on the foundation 3 via a plate 4 secured to the foundation, and is secured to the foundation by means of two rows of bolts 5 provided with nuts. An oil pan 6 is recessed in the foundation 3.

Figure 2:
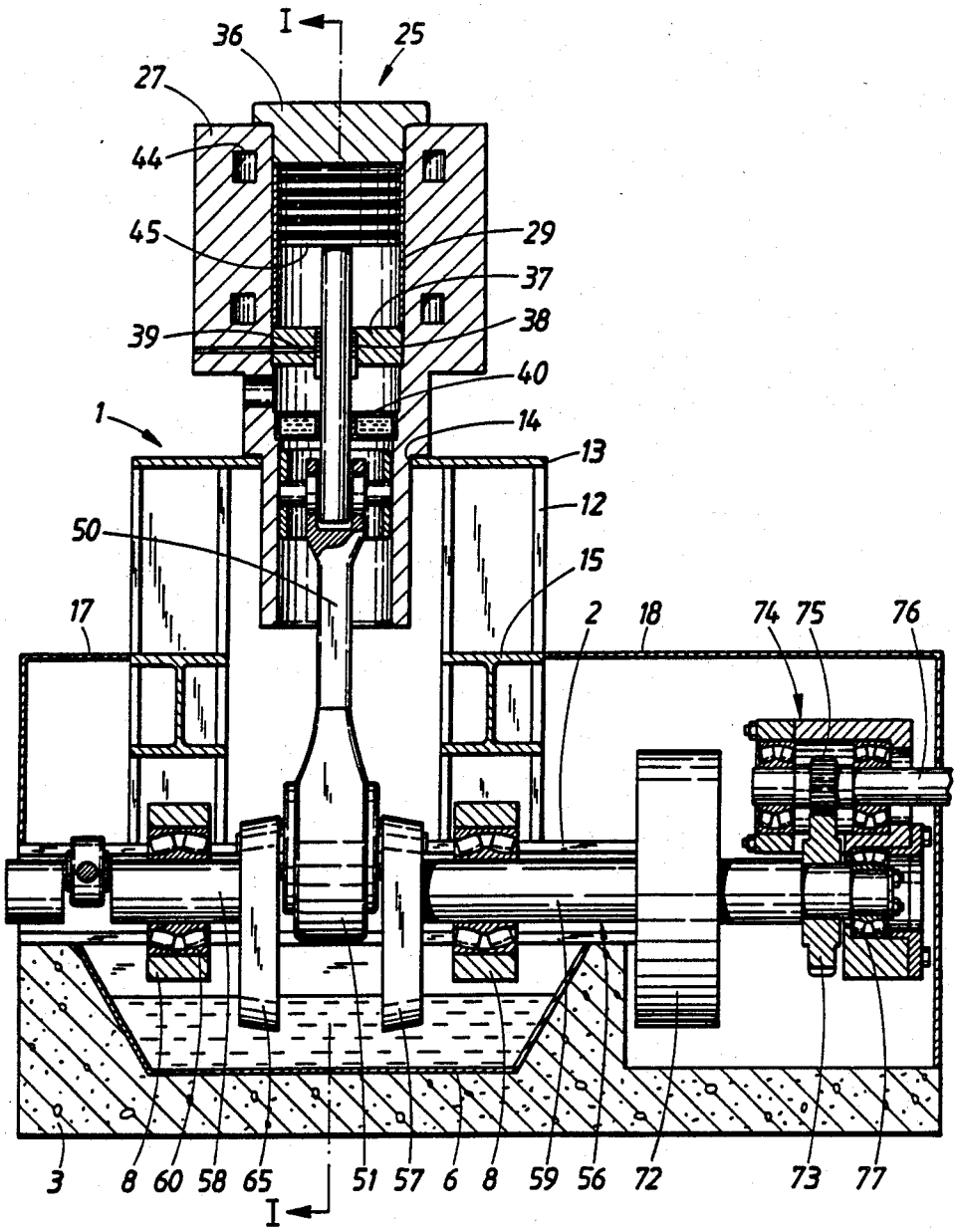
FIG. 2 is a cross section view taken along line II-II in FIG. 1.

Extending inwardly from the I-beams 2 towards the geometric center of the crankcase frame are plates 7, which support the engine's crankshaft bearings 8 by means of screws 9. Four standing I-beams 12 (Cf. FIG. 2) extend upwards from the I-beams 2, the standing I-beams together supporting an upper plate 13 containing a hole 14. Furthermore, the I-beams 12 are connected by two transverse I-beams 15, which, in FIG. 1, are partially obscured by plates 16. Said plates 16 stand upright and extend between the crankshaft bearings 8 and between the I-beams 2 and the plate 13 and terminate inwardly in line with the side edge of the hole 14.

The elements described above generally comprise the supporting members of the crankcase 1. There are additionally certain enclosing members such as end covers 17 and 18, which are provided at the ends (see FIG. 2) of the crankcase frame 1 which forms the engine support. There may also be additional enclosing covers or securely welded plates but these are not shown. Mechanisms for regulating valves and slides, which are supported by the frame, are not described herein since the main purpose is to disclose solutions for supporting and power transmitting members. Besides, such mechanisms are known previously.

The plate 13 supports a cylinder 25, the lower end portion 26 of which has an outer diameter reduced by means of lathing and which is guided into the hole 14 in the plate 13. The cylinder's 25 upper portion 27, above the plate 13, has uppermost a cylinder bore 28 in an inserted cylinder lining 29, for which a drill hole 30 is provided from the cylinder's 25 upper end. The drill hole 30 terminates at a lower edge 31, which, after a transition, is followed by a guide 32 with an edge 33. Thereafter follows a guide 34 in the cylinder's lower portion 26, which opens into the crankcase frame 1.

The cylinder's 25 upper end is closed by means of a cylinder cover 36 which fits in the bore 30. A lower cylinder cover 37, provided with a packing box 38, rests against the edge 31. The cylinder lining 29 is secured between the cylinder covers 36 and 37. The packing box is provided with a suction drainage channel 39 for condensed steam. In order to further guarantee that steam does not flow into the crankcase and condense therein, in the guide 32 against the edge 33 an intermediate base 40 is inserted, having an inner cavity 41 from which the intermediate base is cooled by water.

The cylinder 25 is provided with intakes and discharges for steam, which is applied by means of valves (not shown), which are included in said mechanisms. Of the steam distribution system in the cylinder, only the distribution channel 44 is shown in the cross-section.

A piston 45 is movably arranged in the cylinder bore 28. It is fastened to a piston rod 46, which extends downwards through the packing box 38 and the intermediate base 40 to a cylindrical transverse section 48, which can reciprocate in a guide. A pin 49 joins the cylindrical section 48 and the piston rod 46 with a connecting rod 50. The bearings for the reciprocating motion of the connecting rod are most suitably in the form of needle bearings. The connecting rod 50 continues downwards to a connecting rod end 51, which is mounted on a crank pin 55 by means of a roller bearing 52. The crank pin belongs to a crankshaft 56, which also includes crank webs 57 and 65 as well as a forward crankshaft bearing pin 58 and a rear crankshaft bearing pin 59 (FIG. 2). The crankshaft bearing pins 58 and 59 are mounted in the crankshaft bearing 8. In this case, roller bearings 60 are envisioned.

Figure 3:
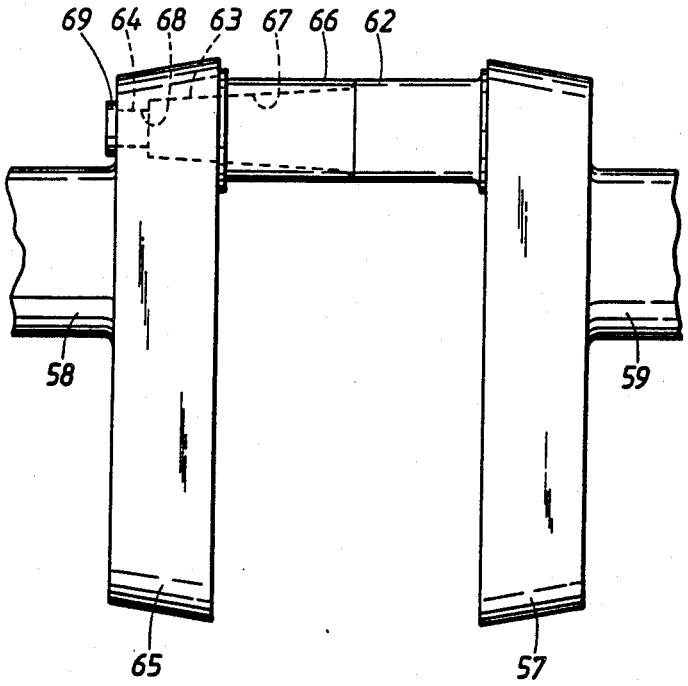
FIG. 3 is an enlarged illustration of the crankshaft of the steam engine shown in FIG. 1.

In order for the connecting rod end 51, with its undivided roller bearings, to be able to be mounted on the crank pin 55, the crank pin must be divided. Consequently, a first portion 62 of the crank pin 55, corresponding to approximately half its length, protrudes from one crank web 57 of the crankshaft, in FIG. 3, the crank web on the right. This is continued with a conic portion 63, which terminates with a threaded end portion 64. The other crank web, the left, herein designated 65, is also provided with a crank pin portion 66, which forms the remaining portion of the crank pin 55. Through the pin portion 66 and the remaining portion of the crank web 65 extends a conical hole 67, which terminates with a cylindrical hole 68 through which extends the threaded end portion 64. The conical portion 63 is secured in the hole 67 by means of a nut 69 on the crank web's 65 outer side, which nut fits the threaded end pin 64.

The crank bearing pins 58 and 59 on the crankshaft are cylindrical and, therefore, the roller bearings, which form the crank bearings, can be slid on from the ends of the pins, requiring no further division of the crankshaft. If, however, the steam engine is fashioned as being multicylinder, the crankshaft must also be divided at the intermediate crank bearing pins, and the bearings cannot then be slid on from the ends. A connection corresponding to the one described can also be accomplished for the crank bearing pins.

FIG. 2 also shows that the crank bearing pin 59 is provided with a flywheel 72, beyond which is located a driving wheel 73 to a gear drive 74, also containing a smaller driven wheel 75 on an output shaft 76. In this way the suitably relatively low rotation speed of the steam engine can be changed up to a higher speed, suitable for operation of a four-pole AC generator, that is, 1500 rpms at 50 Hz. The gear 74 is shown as being so-called pin-gear, which is supported by the driving axle 59 by means of a bearing 77 and which requires firm support only for absorbing reaction forces.

By means of the illustrated embodiment of the crankcase frame, the frame can be produced in a simple fashion, which allows for efficient production even of a small series. Production is accomplished by means of welding commercially available profiles and easily cut plates. The cylinder can be fashioned as a unit to be secured to the crankcase and it also forms a bearing for the sliding portion of the piston rod. If the connecting rod end is mounted using spherical bearings the adjustment of the cylinder does not need to be exceedingly precise but rather one can use simple mounting on a plate supported by the standing beams. The cylinder unit is further made so as to be able to use condensed waste steam, which is of value especially where it is difficult to obtain completely pure water for producing steam. Use of a piston with self-lubricating surfaces if further intended so that there will be no danger of oil polluting the condensate.

By chosing roller bearings for the moving parts of the engine, small power losses and simple lubrication are achieved. It is assumed that lubrication will be achieved by splashing from the oil pan 6.

I claim:

1. A steam engine comprising:

a crankshaft having crank webs supporting a crankpin;

a plurality of crankshaft bearings supporting said crankshaft for rotation around a generally horizontal axis;

a pair of horizontally lying beams extending generally parallel to, and on opposite sides of the crankshaft, a plurality of bearing support members, each bearing support member extending generally perpendicularly to the axis of rotation and supported by the horizontally lying beams, the bearing support members supporting the crankshaft bearings;

a plurality of vertically standing beams extending upwardly from said horizontally lying beams;

a horizontally lying plate, having an upper side and including a hole, said horizontally lying plate being supported by said vertically standing beams;

a cylinder including a lower portion adapted to extend downwardly through said hole and including a flange surface adapted to rest against said upper side of said plate when said lower portion of said cylinder extends downwardly through said hole;

a piston reciprocable within said cylinder; and means including a piston rod and a connecting rod for rotating said crankshaft in response to reciprocation of said piston within said cylinder.

2. A steam engine as set forth in claim 1 and further including additional beams extending substantially horizontally between said vertically standing beams for bracing said vertically standing beams.

3. A steam engine as set forth in claim 2 wherein each of said horizontally lying beams is of substantially I-shaped cross section defined by a first generally planar, generally horizontally disposed portion, a second generally planar, generally horizontally disposed portion spaced from and generally parallel to the first generally planar portion, and a web portion generally perpendicular to and connecting the first generally planar portion to the second generally planar portion, and wherein each of said bearing support members is welded to the web portion of the horizontal beam supporting the bearing support member.

4. A steam engine as set forth in claim 1 wherein each of said bearing support members is a plate extending between said vertically standing beams in a plane oriented substantially perpendicularly to the longitudinal direction of said crankshaft.

5. A steam engine as set forth in claim 1 wherein said cylinder comprises a unitary structure having an upper end, a lower end and a bore extending from said upper end to said lower end, the diameter of said bore decreasing stepwise from said upper end to said lower end so as to form, within said cylinder, at least one annular interior shoulder.

6. A steam engine as set forth in claim 5 wherein said cylinder includes a first shoulder, an inner cylindrical disc supported by said first shoulder, and a cross head guide positioned within said bore below said inner cylindrical disc, said cylindrical disc including an aperture having extending therethrough said piston rod.

7. A steam engine as set forth in claim 6 and further including an intermediate base within said bore between said inner cylindrical disc and said cross head guide, said intermediate base including a cavity for containing coolant, said intermediate base being operable to condense and collect steam escaping through said aperture around said piston rod.

8. A steam engine in accordance with claim 1, wherein said connecting rod engages said crankpin, and further including a bearing between said connecting rod and said crankpin.

9. A steam engine as set forth in claim 1 further including a foundation adapted to support said horizontally lying beams and having an upper surface, said upper surface including a cavity defining an oil pan between said horizontally lying beams.

10. A steam engine as set forth in claim 1 wherein each of said horizontally lying and vertically standing beams is of substantially uniform cross-section along its length.

11. A steam engine as set forth in claim 1 wherein the cross-sectional configuration of said horizontally lying beams is substantially similar to the cross-sectional configuration of said vertically standing beams.

12. A steam engine as set forth in claim 1 and further including a connecting rod bearing between the connecting rod and the crankpin and wherein said crankpin includes a conical first portion extending from one of said crank webs and having a threaded outer portion, said crankpin further including a second portion extending from the next adjacent crank web and having a conical hole adapted to receive said first conical portion and thereby form a surface for supporting said connecting rod bearing, said crankpin further including a threaded element engaging said threaded outer end of said first conical portion to secure said first outer conical portion to said second portion.

13. A steam engine comprising:

a crankshaft having crank webs supporting a crankpin;

a plurality of crankshaft bearings supporting the crankshaft for rotation about a generally horizontal axis;

a foundation including an upwardly open recess in the foundation, the recess defining a lubricating fluid container;

a pair of spaced apart horizontal beams supported on the foundation, the beams positioned on opposite sides of the recess and being above the recess, bearing support members extending generally perpendicularly to the axis of rotation and supported by the horizontal beams, the bearing support members supporting the crankshaft bearings;

a plurality of vertical beams extending upwardly from the spaced apart horizontal beams;

a horizontal plate having an upper side and including a hole, the horizontal plate being supported by the vertical beams;

a cylinder including a lower portion adapted to extend downwardly through the hole and including a flange surface adapted to rest against the upper side of the plate when the lower portion of the cylinder extends downwardly through the hole;

a piston reciprocable within the cylinder; and means including a piston rod and a connecting rod for rotating the crankshaft in response to reciprocation of the piston within the cylinder.

14. A steam engine as set forth in claim 13 wherein said foundation is made of poured concrete.

15. A steam engine comprising:

a crankshaft having crank webs supporting a crankpin;

a plurality of crankshaft bearings supporting said crankshaft for rotation around a generally horizontal axis;

a pair of horizontally lying beams extending generally parallel to, and on opposite sides of the crankshaft, a plurality of bearing support members, each bearing support member extending generally perpendicularly to the axis of rotation and supported by the horizontal beams, the bearing support members supporting the crankshaft bearings;

a plurality of vertical beams extending upwardly from the spaced apart horizontal beams;

a horizontally lying plate, having an upper side and including a hole, said horizontal plate being supported by said vertically standing beams;

a cylinder including a lower portion adapted to extend downwardly through said hole and including a flange surface adapted to rest against said upper side of said plate when said lower portion of the cylinder extends downwardly through said hole, said cylinder comprising a unitary structure having an upper end, a lower end and a bore extending from said upper end to said lower end, the diameter of said bore decreasing stepwise from said upper end to said lower end so as to form, within said cylinder, at least one annular interior shoulder;

a piston reciprocable within the cylinder; and means including a piston rod and a connecting rod for rotating the crankshaft in response to reciprocation of the piston within the cylinder.

16. A steam engine as set forth in claim 15 wherein said cylinder includes a first shoulder, an inner cylindrical disc supported by said first shoulder, and a cross head guide positioned within said bore below said inner cylindrical disc, said cylindrical disc including an aperture having extending therethrough said piston rod.

17. A steam engine as set forth in claim 16 and further including an intermediate base within said bore between said inner cylindrical disc and said cross head guide, said intermediate base including a cavity for containing coolant, said intermediate base being operable to condense and collect steam escaping through said aperture around said piston rod.

18. A steam engine comprising:

a crankshaft having crank webs supporting a crankpin;

a plurality of crankshaft bearings supporting the crankshaft for rotation about a generally horizontal axis;

a foundation of poured concrete including an upwardly open recess in the foundation, the recess defining a lubricating fluid container;

a pair of spaced apart horizontal beams supported on the foundation, the beams positioned on opposite sides of the recess and being above the recess, bearing support members extending generally perpendicularly to the axis of rotation and supported by the horizontal beams, the bearing support members supporting the crankshaft bearings;

a plurality of vertical beams extending upwardly from the spaced apart horizontal beams;

a horizontal plate having an upper side and including a hole, the horizontal plate being supported by the vertical beams;

a cylinder including a lower portion adapted to extend downwardly through the hole and including a flange surface adapted to rest against the upper side of the plate when the lower portion of the cylinder extends downwardly through the hole;

a piston reciprocable within the cylinder; and means including a piston rod and a connecting rod for rotating the crankshaft in response to reciprocation of the piston within the cylinder.

19. A steam engine comprising:

a crankshaft having crank webs supporting a crankpin;

a plurality of crankshaft bearings supporting said crankshaft for rotation about a generally horizontal axis;

a pair of spaced apart horizontal beams extending generally parallel to, and separated by the crankshaft, a bearing support member extending from each of the spaced apart beams and generally perpendicularly to the axis of rotation to support the crankshaft bearings, each of said horizontally lying beams being of substantially I-shaped cross section defined by a first generally planar, generally horizontally disposed portion, a second generally planar, generally horizontally disposed portion spaced from and generally parallel to the first generally planar portion, and a web portion generally perpendicular to and connecting the first generally planar portion to the second generally planar portion, each of said bearing support members being a plate lying in a generally vertical plane which is generally perpendicular to a plane containing one of said web portions;

a plurality of vertical beams extending upwardly from the spaced apart horizontal beams;

a horizontal plate having an upper side and including a hole, the horizontal plate being supported by the vertical beams;

a cylinder including a lower portion adapted to extend downwardly through the hole and including a flange surface adapted to rest against the upper side of the plate when the lower portion of the cylinder extends downwardly through the hole;

a piston reciprocable within the cylinder; and means including a piston rod and a connecting rod for rotating the crankshaft in response to reciprocation of the piston within the cylinder.

* * * * *